United States Patent [19]

Sumigawa

[11] Patent Number: 5,006,083

[45] Date of Patent: Apr. 9, 1991

[54] TILTING DEVICE FOR MARINE PROPULSION UNIT

[75] Inventor: Yukio Sumigawa, Hamamatsu, Japan

[73] Assignee: Sanshin Kogyo Kabushiki Kaisha, Hamamatsu, Japan

[21] Appl. No.: 367,564

[22] Filed: Jun. 19, 1989

[30] Foreign Application Priority Data

Jun. 17, 1988 [JP] Japan ..... 63-148299

[51] Int. Cl.[5] ..... B63H 5/12

[52] U.S. Cl. ..... 440/61

[58] Field of Search ..... 440/55, 56, 61, 63

[56] References Cited

U.S. PATENT DOCUMENTS 3,902,449 9/1975 Berry ..... 440/55

4,013,249 3/1977 Meyer et al. ..... 440/55

FOREIGN PATENT DOCUMENTS 57-95295 6/1982 Japan ..... 440/61

*Primary Examiner*—Joseph F. Peters, Jr.

*Assistant Examiner*—Jesûs D. Sotelo

*Attorney, Agent, or Firm*—Ernest A. Beutler

[57] ABSTRACT

A tilting device for a tiltable outboard drive unit on a marine vessel which prevents the drive unit, when in the tilted-down position, from freely moving toward the tilted-up position during normal operation. The tilting device includes a tilt cylinder device having a bypass valve, and is arranged so that the bypass valve of the tilt cylinder device is automatically closed when the drive unit is in the tilted-up position. Thereafter, when the drive unit is moved to the tilted-down position the bypass valve remains closed, thereby preventing the drive unit from freely moving toward the tilted-up position during normal operation.

14 Claims, 6 Drawing Sheets

TILTING DEVICE FOR MARINE PROPULSION UNIT

BACKGROUND OF THE INVENTION

The invention relates to a tilting device for a marine drive unit, such as an outboard engine or the outboard drive portion of an inboard/outboard engine for boats, rafts and other marine vessels which prevents the drive unit, when in the tilted-down position, from freely moving toward the tilted-up position during normal operation.

One form of outboard drive unit is attached to the hull of a marine vessel by a clamp bracket and an elongated swivel bracket secured to the clamp bracket by a tilt shaft that allows the drive unit to be selectively tilted downwardly into, or upwardly out of, the water. This type of swivel bracket is normally used on vessels having a high transom such as sail boats.

A lower position stop pin, engageable with the swivel bracket, is typically used for setting downward position of the swivel bracket.

In order to perform satisfactorily, the drive unit should preferably include a tilt cylinder device, having two check valves and a bypass valve. With such a device, the swivel bracket, when maintained in the tilted-up position, can be rotated to its tilted-down position against the pressure of an assist gas because the second check valve permits the release of pressure even when the bypass valve is closed.

When the bypass valve is in the open position and the swivel bracket is in the tilted-down position, however, the swivel bracket is moveable toward the tilted-up position when the vessel is driven in the reverse direction. The tilting device is arranged to automatically prevent such free movement. The tilting device is arranged so that the bypass valve of the tilt cylinder device is automatically closed when the swivel bracket is rotated to the tilted-up position. The tilting device is further arranged so that the bypass valve remains in the closed position when the swivel bracket is tilted down, thereby preventing the drive unit from freely tilting up during normal operation.

SUMMARY OF THE INVENTION

A tilting device in an outboard drive unit which prevents the swivel bracket and, accordingly, the drive unit, when in the tilted-down position, from freely moving toward the tilted-up position during normal operation of said drive unit. Preferably, the outboard drive unit includes a clamp bracket having a slot and a slot stop surface therein, a tilt shaft, and a swivel bracket having a slot. The clamp bracket is attached at one end to the hull of a marine vessel. The swivel bracket is rotatably secured to the clamp bracket by the tilt shaft for pivotal movement of the drive unit between a tilted-down position and a tilted-up position. Preferably, the outboard drive unit also includes a lower position stop pin, engageable with the swivel bracket, for setting the downward position of the swivel bracket.

Preferably, the tilting device further includes a tilt cylinder device to maintain the drive unit in the downward position during normal operation but to permit the drive unit to swing upwardly in the event of a collision with a submerged obstacle when the bypass valve is closed.

The tilting device is arranged such that the bypass valve of the tilt cylinder device is automatically closed when the swivel bracket is moved to the tilted-up position. Thereafter, when the swivel bracket is moved to the tilted-down position, the bypass valve remains in the closed position, thereby preventing the drive unit from tilting up during normal operation.

BRIEF DESCRIPTION OF THE DRAWINGS

FIG. 4 shows the tilting device with the lock arm in the release position, the manual lever in its downward position and the bypass valve open.

FIG. 5 shows the tilting device when the swivel bracket is in the tilted-up position, the lock arm is in the locked position and the bypass valve is closed.

FIG. 6 shows the tilting device with the manual lever in its upward position, the lock arm in its release position and the bypass valve closed.

FIG. 7 is a schematic cross-sectional view of the position of the tilt cylinder device when the outboard drive unit is raised to its fully lifted position.

FIG. 8 is a schematic cross-sectional view of the position of the tilt cylinder device as it lowers the drive unit back to its normal running position.

DETAILED DESCRIPTION OF THE PREFERRED EMBODIMENTS

For purpose of describing and illustrating the principles and function of the invention, the drawings illustrate an outboard engine unit, generally referred to herein as a drive unit. The invention is not so limited, however, as it is equally applicable to vessels having inboard engines with outboard drive apparatus as well as other vessels having vertically pivotable drive configurations.

Figure 1:
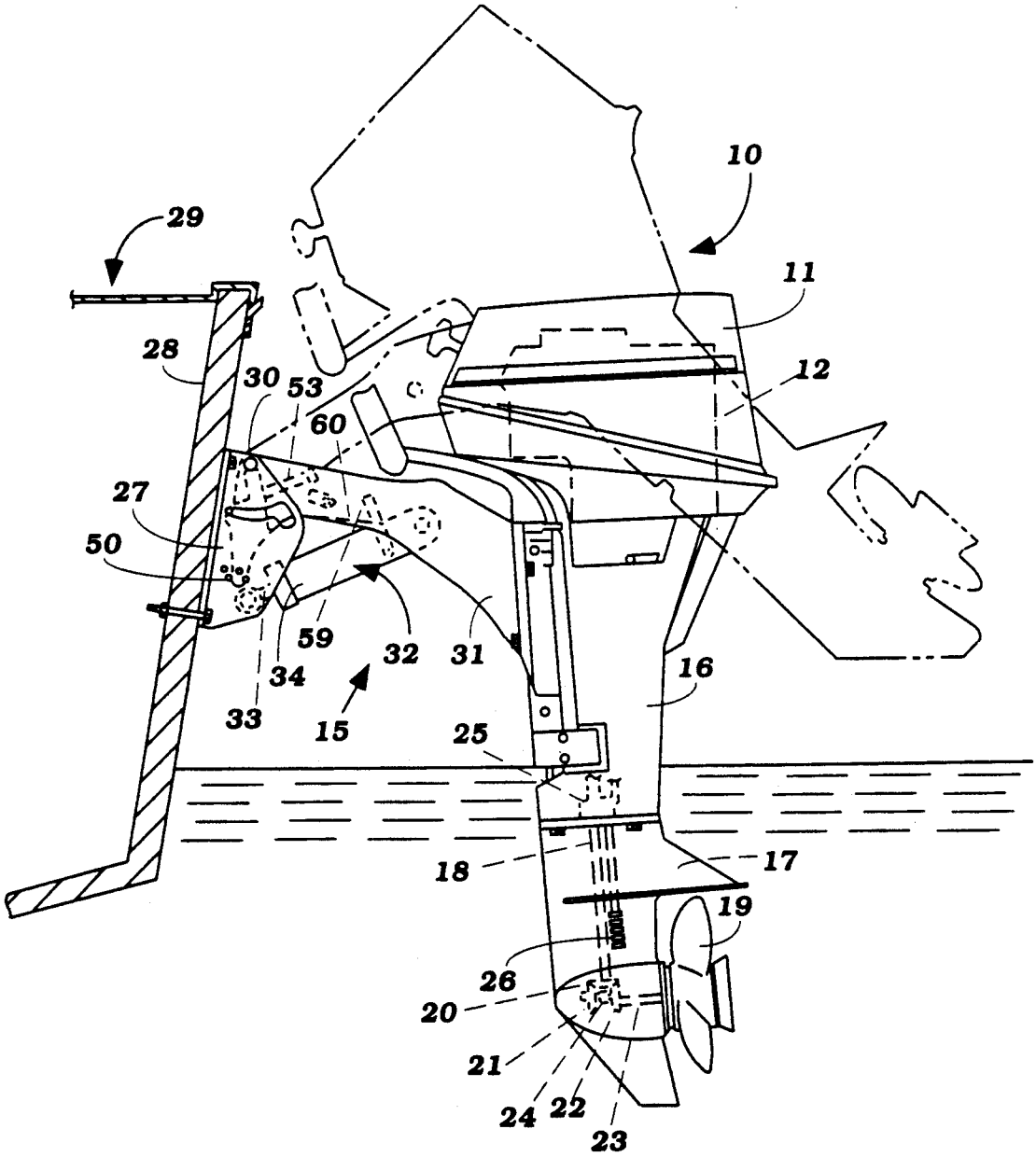
FIG. 1 is a left-side elevational view, cut away in part and parts shown in section, of an outboard drive unit embodying the present invention.

FIG. 1 illustrates a typical outboard drive unit 10 having a power head 11 including an engine 12, a tilting device 15, a drive shaft housing 16, and a lower unit 17. The lower unit 17 includes a drive shaft 18 which is journaled within the lower unit 17 by means of a support bearing (not shown) and is driven at the upper end thereof by the engine 12.

A forward, neutral, reverse transmission is positioned within the lower unit 17 for selectively driving a propeller 19 in forward or reverse directions. This forward, neutral, reverse transmission is comprised of a driving bevel gear 20 that is affixed to the lower end of the drive shaft 18. The driving bevel gear 20 is in mesh with a pair of counterrotating driven bevel gears 21 and 22. These driven bevel gears 21 and 22 are journaled upon a propeller shaft 23, which, in turn, is affixed to the propeller 19 by means of an elastic coupling. Supported on the propeller shaft 23 is a dog clutching sleeve 24 that has a splined connection to the propeller shaft 23 for rotation with this shaft and axial movement along it. The dog clutching sleeve 24 has oppositely facing dog clutching teeth that are adapted to cooperate with complementary dog clutching teeth formed on gears 21 and 22 for selectively coupling the gears 21 or 22 for rotation with the propeller shaft 23.

The drive unit 10 is provided with a cooling system of the water cooled type. The cooling system includes a circulating pump 25 that is driven by the engine 12 of the drive unit 10 in a suitable manner and which circulates coolant through the engine cooling jacket for discharge back into the body of water in which the watercraft is operating along with the exhaust gases from the engine. The cooling system further includes a water intake port 26 that is formed in the lower unit 17 of the drive unit 10 and which communicates with an internal passageway that is formed within the housing of the lower unit 17 by means of an integral passageway. The integral passageway communicates with the circulating pump 25 by means of a series of conduits.

The drive unit 10 also includes a clamp bracket 27 attached to the hull 28 of a marine vessel 29, a tilt shaft 30 and a swivel bracket 31 secured at one end to the tilt shaft 30 for movement of the drive unit 10 between a tilted-down position wherein the propeller 19 is positioned beneath the water and a tilted-up position wherein the propeller 19 is out of the water. The swivel bracket 31 is secured at the other end to the drive shaft housing 16 for steering movement.

The tilting device 15 includes a tilt cylinder device 32, having a rod 33 and a cylinder 34, secured at one end of the clamp bracket 27 and secured at the other end to the swivel bracket 31, to maintain the drive unit 10 in a downward position during normal operation but to permit the drive unit 10 to swing upwardly in the event of a collision with a submerged obstacle. Drive unit 10 is illustrated in solid lines in its down position, and in broken lines in its up or lifted position, in FIG. 1. The outboard drive unit 10 also includes a lower position stop pin 50 for deciding the downward position of the swivel bracket 31.

Figure 2:
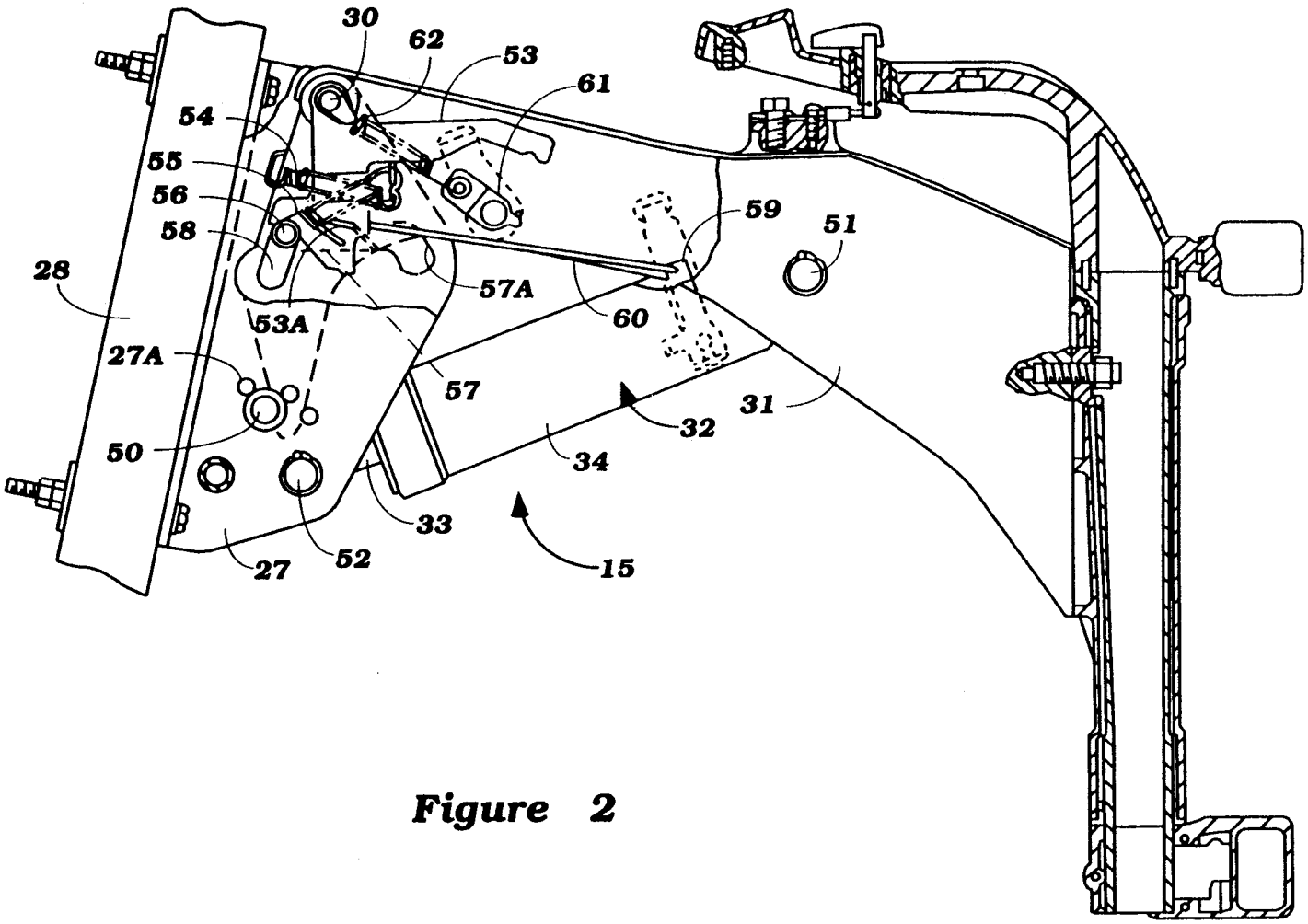
FIG. 2 is a detailed side view, cut away in part and parts shown in section, of the pivotable support assembly and tilting device.

In FIG. 2, the clamp bracket 27 has a series of trim apertures 27A, 27B, 27C and 27D extending laterally therethrough for receiving the lower position stop pin 50 therein for setting the downward position of the swivel bracket 31. Thus, the angle of the drive unit 10 with respect to the hull 28 of the marine vessel 29 may be selectively varied by the operator in accordance with desired operating conditions merely by inserting the lower position stop pin 50 in the appropriate trim aperture 27A, 27B, 27C, or 27D, in the clamp bracket 27. The tilt cylinder device 32 extendably connects the clamp bracket 27 with the swivel bracket 31. The cylinder 34 of the tilt cylinder device 32 is pivotally secured to the swivel bracket 31 by a first connecting pin 51. The rod 33 of the tilt cylinder device 32 is pivotally secured to the clamp bracket 27 by a second connecting pin 52.

Figure 3:
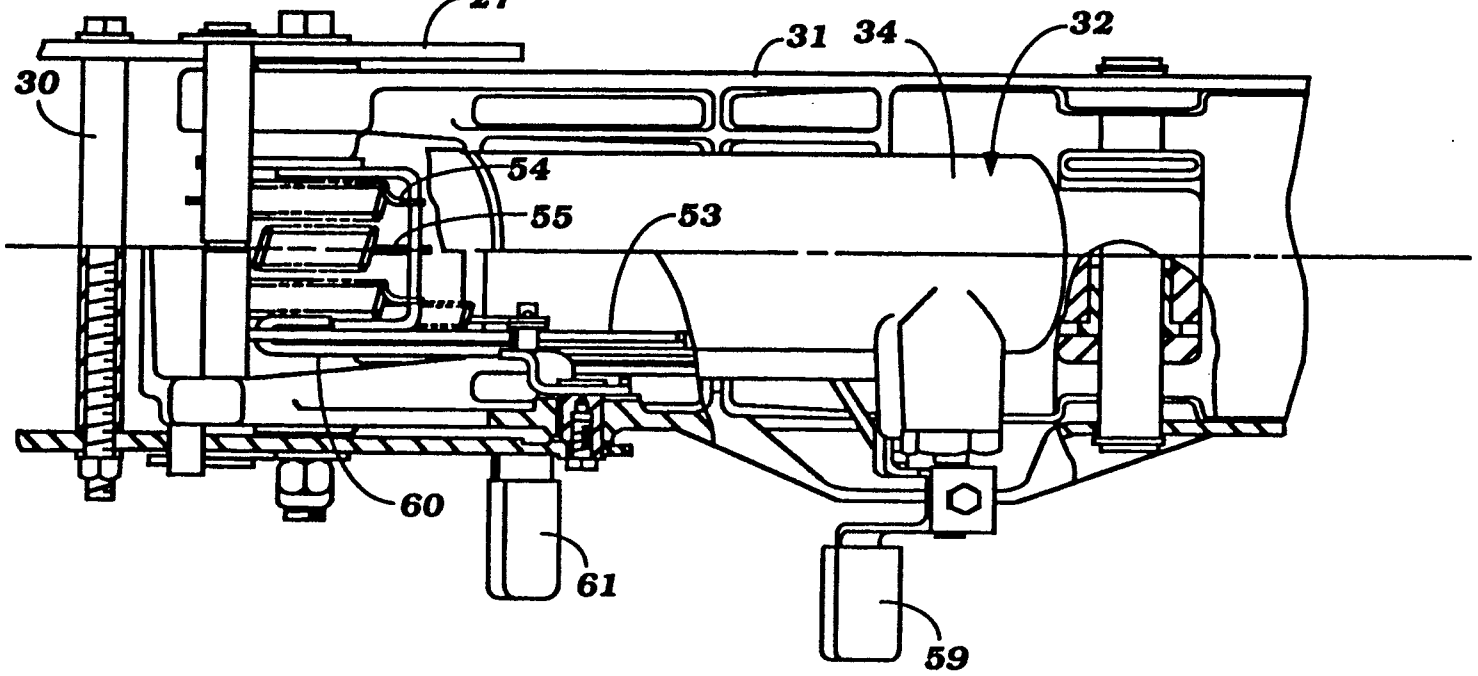
FIG. 3 is a detailed bottom view, cut away in part and parts shown in section, of the tilting device.

In FIGS. 2 and 3, a tilt lock arm 53 is rotatably supported about the tilt shaft 30. A first spring 54 is provided for rotating the lock arm 53 in a locked position when the swivel bracket 31 is in the tilted-up position. The first spring 54 is connected at one end to the swivel bracket 31 and connected at the other end to the lock arm 53 for biasing the lock arm 53 relative to the swivel bracket 31. A second spring 55 is connected at one end to the lock arm 53 and attached at the other end to an upper position stop pin 56.

When the lock arm 53 is in the locked position and the swivel bracket 31 is in the tilted-up position, the upper position stop pin 56, engageable with both a clamp bracket slot 57 and a swivel bracket slot 58, is engaged with a stop surface 57A of the clamp bracket slot 57 so that the swivel bracket 31 is prevented from moving. In such a case, the swivel bracket 31 is prevented from moving in the down direction by the action of the upper position stop pin 56. The swivel bracket 31 is prevented from moving toward the up direction by the closure of a bypass valve 36. A valve lever 59 is connected to the bypass valve 36 for opening and closing the bypass valve 36. A connecting link 60 extends between the lock arm 53 and the valve lever 59 so that the movement of the lock arm 53 to the locked position when the swivel bracket 31 is tilted-up causes the bypass valve 36 to be closed.

A manual lever 61 and third spring 62 are provided for shifting the lock arm 53 from the locked position to a release position. The third spring 62 is connected at one end to the tilt shaft 30 and connected at the other end to a pin 64 in the manual lever 61 (see FIGS. 4, 5 and 6).

When the lock arm 53 is moved to the release position, the second spring 55, connected at one end to the lock arm 53 and attached at the end to the upper position stop pin 56, pulls the upper position stop pin 56 upward along the swivel bracket slot 58 so the swivel bracket 31 can be rotated to the tilted-down position. In this case, the connecting link 60 does not transmit the rotation of the lock arm 53 to the valve lever 59 because of a slot 53A positioned in the lock arm 53. When the lock arm 53 is rotated to the release position, the connecting link 60 changes position within the lock arm slot 53A but does not move. Thus, the bypass valve 36 remains in the closed position when the swivel bracket 31 is in the tilted-down position. The swivel bracket 31 is prevented from moving toward the down direction by the action of the lower position stop pin 50 and toward the up direction by the closure of the bypass valve 36.

Figure 4:
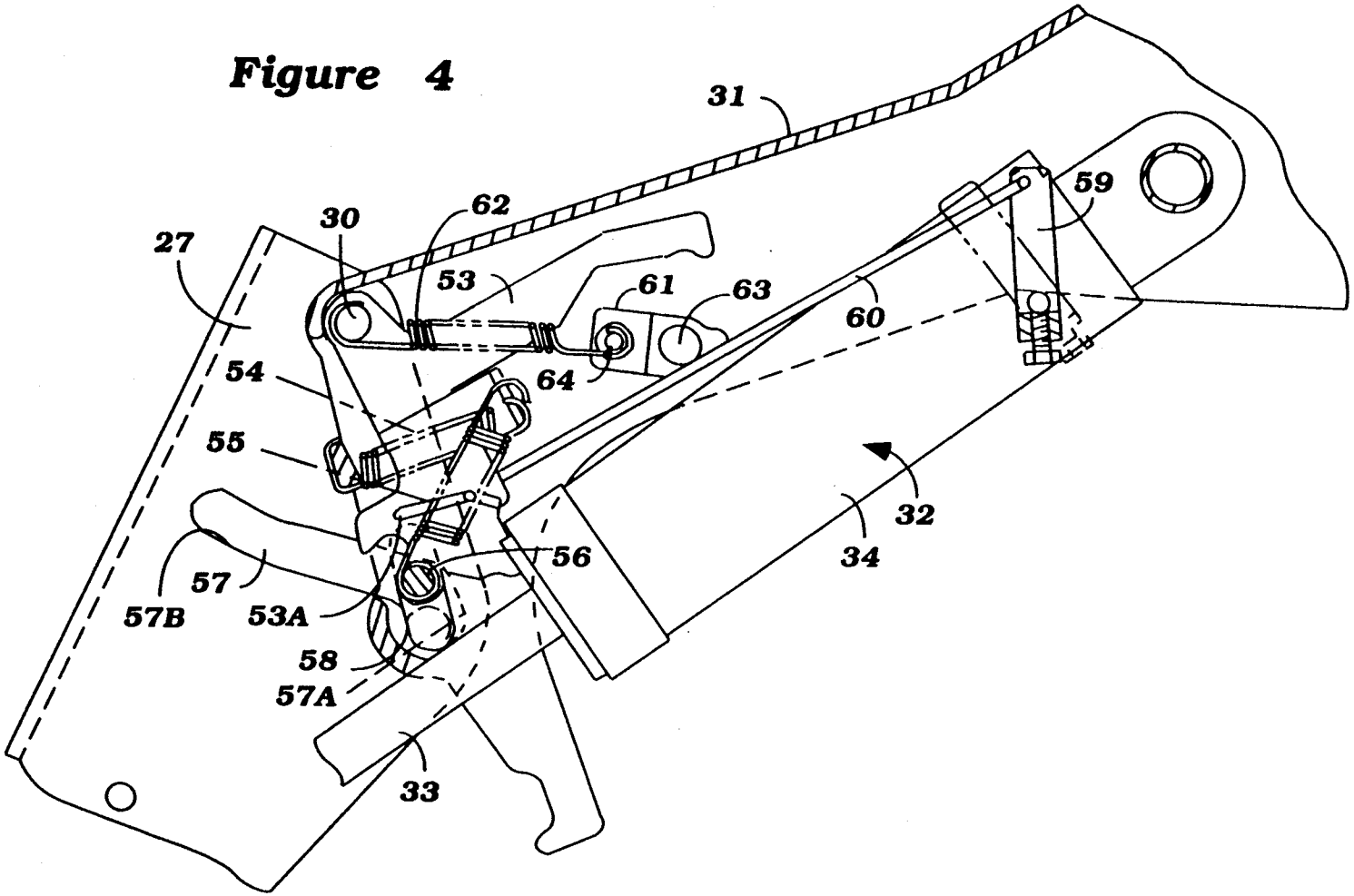
FIGS. 4, 5 and 6 are detailed side views showing the operation of the tilting device.
Figure 5:
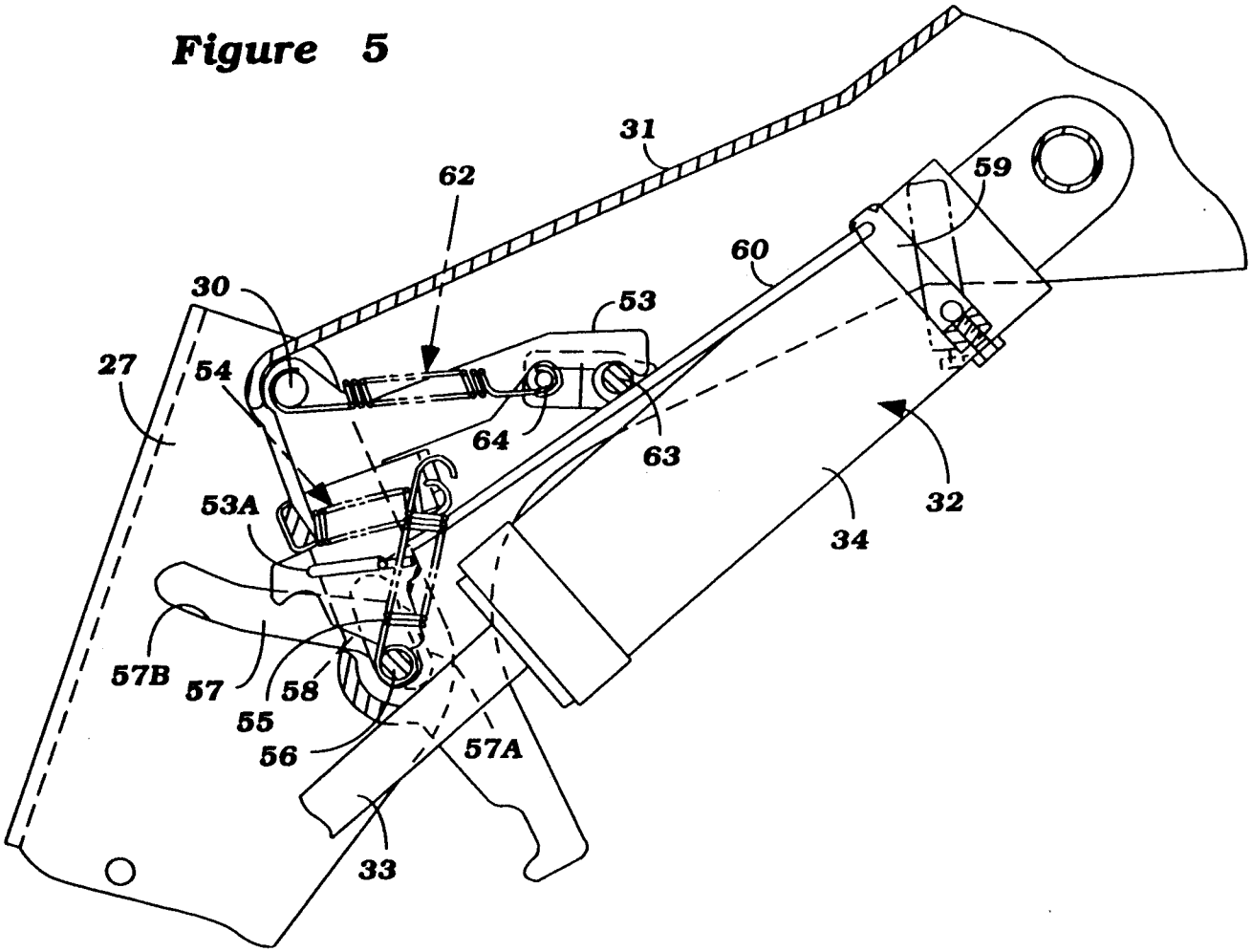
Figure 6:
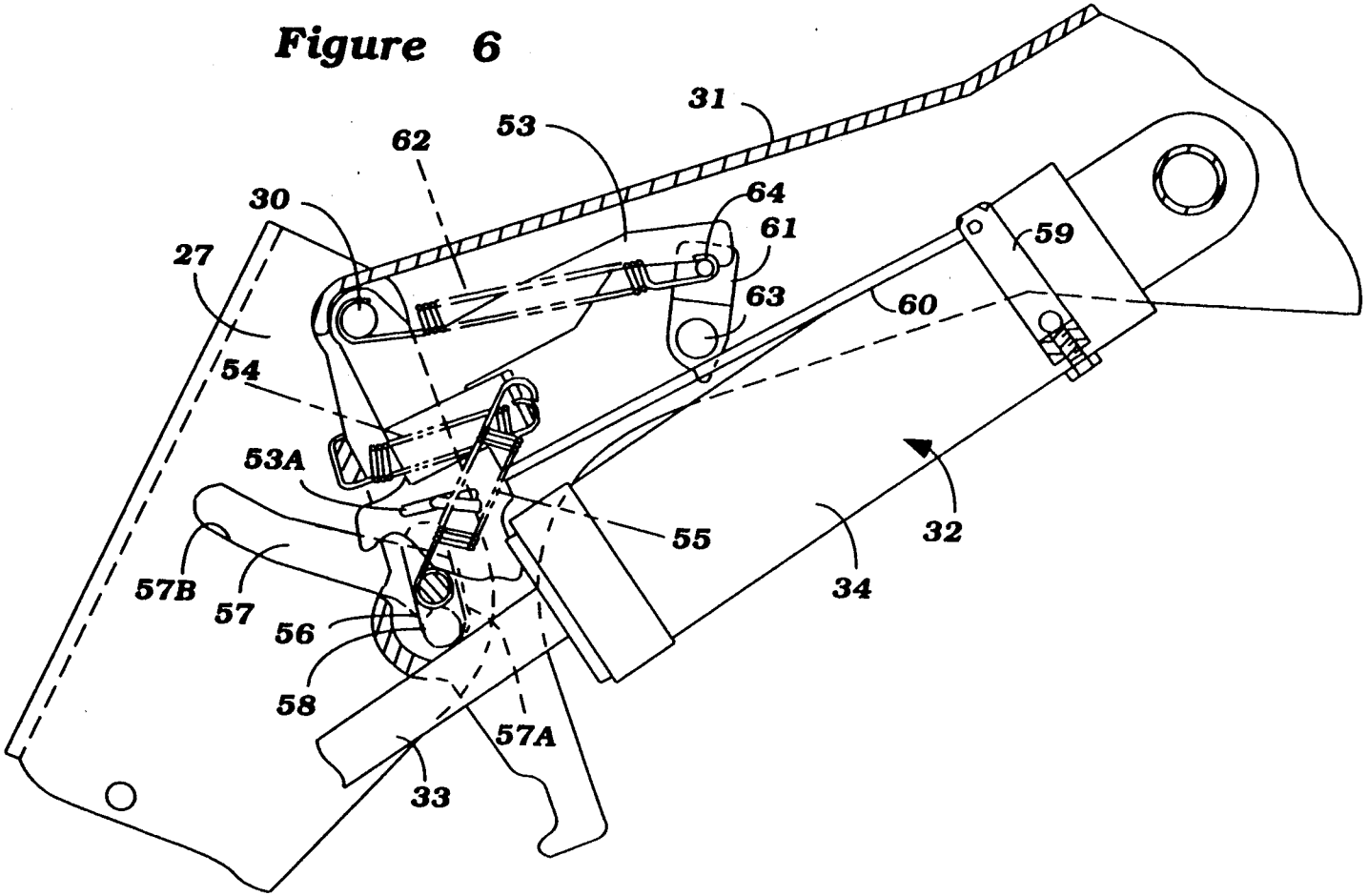

FIGS. 4, 5 and 6 show the details and operation of the preferred embodiments of the tilting device 15. At the tilted-down position, the valve lever 59 can be manually rotated for opening the bypass valve 36 when the lock arm 53 is in the release position. The rotation of the valve lever 59 causes the connecting link 60 to move along in the lock arm slot 53A, thereby permitting the drive unit 10 to be tilted-up. Thus, the movement of the valve lever 59 is not counteracted by the force of the first spring 54.

As the swivel bracket 31 is rotated to the tilted-up position, the upward movement of the swivel bracket 31 causes the upper position stop pin 56 to move within a slide surface 57B of the clamp bracket slot 57 away from the hull 28 of the vessel 29. When the swivel bracket 31 is rotated to the tilted-up position and the upper position stop pin 56 is at the right end of slot 57, the first spring 54 pulls the lock arm 53 clockwise, causing the cam face of the lock arm 53 to push the upper position stop pin 56 downward within the swivel bracket slot 58 to engage with the stop surface 57A of the clamp bracket slot 57, as shown in FIG. 5. When the upper position stop pin 56 engages with the stop surface 57A, the lock arm 53 is in its locked or downward position, resting against a knob 63 of the manual lever 61. The rotation of the lock arm 53 to the locked position pulls the connecting link 60, extending between the valve lever 59 and the lock arm 53, toward the vessel 29, thereby moving the bypass valve 36 into the closed position. In this condition, the swivel bracket 31 is prevented from moving toward the down direction by the engagement of the upper position stop pin 56 with the clamp bracket stop surface 57A. The swivel bracket 31 is prevented from moving toward the up direction by the automatic closure of the bypass valve 36.

A manual lever 61 is rotated or pulled toward the vessel 29 to an upper position to push up the lock arm 53 from the locked position to a release position, as shown in FIG. 6. As the lever 61 is rotated and the lock arm 53 is moved to the release position, the second spring 55 pulls the upper position stop pin 56 upward within the swivel bracket slot 58 and into engagement with the slide surface 57B of the clamp bracket slot 57. However, in this instance, the movement of the lock arm 53 does not cause the connecting link 60 to open the bypass valve 36 because of slot 53A in the lock arm 53. When the manual lever 61 is in this upper position, the valve lever 59 can be rotated for opening the bypass valve 36 so that the swivel bracket 31 and drive unit 10 can be tilted down quickly when the drive unit 10 is pushed down. If the valve lever 59 is kept in the closed position, the swivel bracket 31 is returned to its tilted position as follows.

The rotation of the swivel bracket 31 to the tilted-down position causes the upper position stop pin 56 to move along the slide surface 57B toward the hull 28 of the vessel 29. As the swivel bracket 31 is tilted down, the shape of the clamp bracket slot causes the lock arm to rotate slightly counterclockwise with respect to the swivel bracket 31 so that the manual lever 61 is returned to its downward position by the action of the third spring 62 and the lock arm 53 is returned to its locked position. However, the movement of the lock arm 53 does not cause the connecting link 60 to open the bypass valve 36 because of slot 53A in the lock arm 53. Therefore, the bypass valve 36 remains in the closed position when the swivel bracket 31 is in the tilted-down position so that the swivel bracket 31 is prevented from moving toward the down direction by the action of the lower position stop pin 50 and toward the up direction by the closure of the bypass valve 36.

The function of the tilt cylinder device 32 is shown in FIGS. 7 and 8. When a piston 35 is fully retracted upwardly into the cylinder 34, the bypass valve 36 is closed, and an assist gas 37 is compressed, such as would occur when the drive unit 10 is lowered in its down or running position shown in solid lines in FIG. 1. In this condition, any rearwardly directed forces on the drive unit 10 such as those normally resulting from decelerating of the vessel or running the drive unit 10 in reverse would tend to urge the cylinder 34 in an upward direction relative to the rod 33 and the piston 35. Because the bypass valve 36 is closed, a working fluid 38 in an annular chamber 39 cannot flow through a bypass passage 41, and thus the downward force of the piston 35 causes the working fluid pressure in the annular chamber 39 to increase. However, the increased pressure in the annular chamber 39 resulting from such rearward forces on the drive unit 10 is not normally sufficient to open a first check valve 42. Therefore, the working fluid 38 in the annular chamber 39 is trapped, and any upward movement of the cylinder 34 relative to the piston 35 is resisted, thereby maintaining the drive unit 10 in its downward or running position.

When the operator has opened the bypass valve 36 so as to tilt the drive unit 10 upwardly to its lifted position, shown in broken lines in FIG. 1, for purposes of service or maintenance, the cylinder 34 is extended upwardly, thus reducing the volume of the annular chamber 39. The reduction in volume in the annular chamber 39 forces the working fluid 38 through the bypass passage into a cylindrical chamber 40.

If the drive unit 10 is tilted to its fully lifted position, the cylinder 34 moves upwardly such that the rod 33 and the piston 35 force virtually all of the working fluid 38 into the cylindrical chamber 40 as is illustrated in FIG. 5. The upward movement of the cylinder 34 is assisted by the pressure of the assist gas 37 to relieve the operator from the necessity of lifting the full weight of the drive unit 10. The pressure is not so high, however, to lift the drive unit 10 by itself. The assist gas 37 also expands to fill the volume of the cylinder 34 that is no longer occupied by the portion of the rod 33 that is extended out of the cylinder 34.

While the rod 33 and the piston 35 are in an extended position, the bypass valve 36 is closed as already described. If the operator rotates the manual lever 61 to push up the lock arm 53 and then releases the drive unit 10, the weight of the drive unit 10 exerts a force on the cylinder 34 in a downward direction relative to the piston 35. Such force is great enough to pressurize the cylindrical chamber 40 sufficiently to open a second check valve 43. The working fluid 38 is thus allowed to flow from the cylindrical chamber 40 through the second check valve 43 into the annular chamber 39, thereby allowing the rod 33 and the piston 35 to retract and dampenly lower the drive unit 10 to its down position. As the rod 33 and the piston 35 retract, the assist gas 37 is compressed to compensate for the volume of the cylinder 34 that is now occupied by the retracted rod 3, as shown in FIG. 8.

In the event that the drive unit 10 collides with a submerged obstacle and the bypass valve 36 is closed, such a collision causes a sudden upward force on the cylinder 34, thereby increasing the working fluid pressure in the annular chamber 39 sufficient to open the first check valve 42. As a result, the working fluid 38 in the annular chamber 39 is forced through the first check valve 42 into the cylindrical chamber 40. The cylinder 34 extends upwardly, allowing the drive unit 10 to swing upwardly to prevent, or at least minimize, the impact damage to the drive unit 10. As the cylinder 34 extends upwardly, the assist gas 37 expands to compensate for the volume of the cylinder 34 formally occupied by the rod 33, as shown in FIG. 8.

After the vessel has passed the submerged object and the drive unit 10 is released, the weight of the drive unit 10 urges the cylinder 34 downward relative to the piston 35, thus closing the first check valve 42 and pressurizing the cylindrical chamber 40 sufficiently to open the second check valve 42 as illustrated in FIG. 6. The working fluid 38 in the cylindrical chamber 40 is then forced through the second check valve 43 into the annular chamber 39, allowing the cylinder 34, to retract downwardly and dampenly return the drive unit 10 to its lowered or running position.

The foregoing description represent merely exemplary embodiments of the invention. Furthermore, although the invention is described herein within the context of outboard marine drive units, the invention is not limited to such an application. One reasonably skilled in the art will readily recognize that the invention is equally applicable to other apparatus or systems having tiltable or pivotable articulated elements. Finally, various changes or modifications may be made in said embodiments without departing from the spirit or scope of the invention.

I claim:

1. An outboard drive unit carrying propelling means for propelling a marine vessel having a hull through water, comprising a clamp bracket having a slot and a slot stop surface therein, a tilt shaft, and a swivel bracket having a slot, said clamp bracket being attached to the hull of said vessel, and said swivel bracket being rotatably secured to said clamp bracket by said tilt shaft for movement about a generally horizontally extending tilt axis between a tilted-down position wherein said propelling means is positioned beneath the water and a tilted-up position wherein said propelling means is out of the water, a lower position stop pin, engageable with said swivel bracket, for setting the downward position of said swivel bracket, said outboard drive unit further comprising a tilting device in which said swivel bracket, when in the tilted-down position, is prevented from freely moving toward the tilted-up position during normal operation of said drive unit, said tilting device comprising a tilt-lock arm rotatably supported about said tilt shaft and a first spring for rotating said lock arm in a locked position when said swivel bracket is in the tilted-up position.

2. An outboard drive unit as recited in claim 1, wherein said tilting device further comprises a tilt cylinder device secured at one end to said swivel bracket and secured at the other end to said clamp bracket.

3. An outboard drive unit as recited in claim 2, wherein said tilt cylinder device includes a cylinder, a piston and a rod slidably moveable within said cylinder.

4. An outboard drive unit as recited in claim 3, wherein said tilt cylinder device includes first and second check valves positioned within said piston and a bypass valve having an opened and closed position.

5. An outboard drive unit as recited in claim 4, wherein said tilting device further comprises a tilt-lock arm rotatably supported about said tilt shaft and a first spring for rotating said lock arm in a locked position when said swivel bracket is in the tilted-up position.

6. An outboard drive unit as recited in claim 5, wherein said tilting device further comprises an upper position stop pin, engageable with both the clamp bracket slot, including the stop surface, and the swivel bracket slot such that, when said swivel bracket is in the tilted-up position and when said lock arm is in the locked position, said upper position stop pin is engaged with the stop surface of the clamp bracket slot, thereby preventing said swivel bracket from moving toward the down direction.

7. An outboard drive unit as recited in claim 6, wherein when said swivel bracket is in the tilted-up position and said lock arm is in the locked position said bypass valve is automatically closed, so that said swivel bracket is prevented from moving toward the up direction.

8. An outboard drive unit as recited in claim 7, wherein said tilting device further comprises a valve lever connected to said bypass valve for opening and closing said bypass valve.

9. An outboard drive unit as recited in claim 8, wherein said tilting device further comprises a connecting link, extending between said lock arm and said valve lever, such that movement of said lock arm to the locked position causes said bypass valve to be closed.

10. An outboard drive unit as recited in claim 9, wherein said tilting device further comprises a manual lever and second and third springs, said second spring being connected at one end to said lock arm and attached at the other end to said upper position stop pin, said third spring being connected at one end to said manual lever and at the other end to said tilt shaft, such that when said manual lever is rotated to an upper position said lock arm is shifted to the release position and said second spring pulls said upper position stop pin upward within the swivel bracket slot so that said swivel bracket can be rotated from the tilted-up position to the tilted-down position.

11. An outboard drive unit as recited in claim 10, wherein as said swivel bracket is tilted down, the shape of the clamp bracket slot causes said lock arm to rotate slightly counterclockwise with respect to said swivel bracket so that said manual lever is returned to its downward position and said lock arm is returned to its locked position.

12. An outboard drive unit as recited in claim 11, wherein when said swivel bracket is rotated to the tilted-down position, said bypass valve remains closed, thereby preventing said swivel bracket from freely moving toward the tilted-up position during normal operation of said drive unit.

13. An outboard drive unit carrying propelling means for propelling a marine vessel having a hull through water, comprising a clamp bracket having a slot and a slot stop surface therein, a tilt shaft, and a swivel bracket having a slot, said clamp bracket being attached to the hull of said vessel, and said swivel bracket being rotatably secured to said clamp bracket by said tilt shaft for movement about a generally horizontally extending tilt axis between a tilted-down position wherein said propelling means is positioned beneath the water and a tilted-up position wherein said propelling means is out of the water, a lower position stop pin, engageable with said swivel bracket, for setting the downward position of said swivel bracket, said outboard drive unit further comprising a tilting device in which said swivel bracket, when in the tilted-down position, is prevented from freely moving toward the tilted-up position during normal operation of said drive unit, said tilting device comprising a tilt-lock arm and an upper position stop pin, engageable with both the clamp bracket slot, including the stop surface, and the swivel bracket slot such that, when said swivel bracket is in the tilted-up position and when said lock arm is in a locked position, said upper position stop pin is engaged with the stop surface of the clamp bracket slot, thereby preventing said swivel bracket from moving toward the down direction.

14. An outboard drive unit carrying propelling means for propelling a marine vessel having a hull through water, comprising a clamp bracket, a tilt shaft, and a swivel bracket, said clamp bracket being attached to the hull of said vessel, and said swivel bracket being rotatably secured to said clamp bracket by said tilt shaft for movement about a generally horizontally extending tilt axis between a tilted-down position wherein said propelling means is positioned beneath the water and a tilted-up position wherein said propelling means is out of the water, a lower position stop pin, engageable with said swivel bracket, for setting the downward position of said swivel bracket, said outboard drive unit further comprising a tilting device in which said swivel bracket, when in the tilted-down position, is prevented from freely moving toward the tilted-up position during normal operation of said drive unit, said tilting device comprising a tilt cylinder device including a cylinder, a piston, a rod slidably moveable within said cylinder and a bypass valve having an open and closed position, said tilting device further comprising a tilt-lock arm such that when said swivel bracket is in the tilted-up position and said lock arm is in the locked position said bypass valve is automatically closed so that said swivel bracket is prevented from moving toward the up direction.

* * * * *